US010792535B2

(12) United States Patent
Chou

(10) Patent No.: US 10,792,535 B2
(45) Date of Patent: Oct. 6, 2020

(54) DIP BAR FOR A POWER CAGE

(71) Applicant: Cheng I Chou, City of Industry, CA (US)

(72) Inventor: Cheng I Chou, City of Industry, CA (US)

(73) Assignee: Paradigm Health and Wellness, City of Industry, CA (US)

( * ) Notice: Subject to any disclaimer, the term of this patent is extended or adjusted under 35 U.S.C. 154(b) by 30 days.

(21) Appl. No.: 16/127,582

(22) Filed: Sep. 11, 2018

(65) Prior Publication Data

US 2020/0078633 A1 Mar. 12, 2020

(51) Int. Cl.
*A63B 21/00* (2006.01)
*A63B 1/00* (2006.01)
(Continued)

(52) U.S. Cl.
CPC ..... *A63B 21/4035* (2015.10); *A63B 1/00* (2013.01); *A63B 21/00047* (2013.01);
(Continued)

(58) Field of Classification Search
CPC ..... Y10T 403/7111; Y10T 403/7123; Y10T 403/71852; A63B 21/068; A63B 21/00047; A63B 21/0724; A63B 21/00069; A63B 23/1218; A63B 23/02; A63B 23/0205; A63B 1/00; A63B 1/0233; A63B 1/1227; A63B 1/1218; A63B 2023/0411; A63B 17/00; A63B 17/04; A63B 21/4005;
(Continued)

(56) References Cited

U.S. PATENT DOCUMENTS 3,484,125 A * 12/1969 Randour ..... F16B 3/06 403/370
3,716,231 A * 2/1973 Martin ..... A63B 17/00 482/144

(Continued)

OTHER PUBLICATIONS

HulkFit Multi-Function Adjustable Power cage with J-Hooks, Dip Bars and Optional Lat Pull-Down Attachment. Published on Amazon.com https://www.amazon.com/HulkFit-Multi-Function-Adjustable-Attachment-1000-Pound/dp/B07FBDVJN5/ref=sr_1_1?ie=UTF8&qid=1532627888&sr=8-1&keywords=hulkfit (Year: 2018).*

(Continued)

*Primary Examiner* — Jennifer Robertson
*Assistant Examiner* — Thao N Do
(74) *Attorney, Agent, or Firm* — Kirk A. Buhler; Buhler & Associates Patenting

(57) ABSTRACT

A dip bar that has a frame for securing the dip bar on a power cage. The dip bar wraps partially around the frame to provide multiple locations to grasp the dip bar and provides different spacing from the power cage uprights or stanchions. The frame of the dip bar has a rod, post or tube the passes through cage frame to prevent the dip bar from sliding on the power cage. A pin with a spring-loaded ball prevents the frame from sliding out of engagement in the power cage. The pin is placed through the frame where the spring-loaded ball extends to retain the pin and the frame on the power cage. The dip bar is positionable at different heights and orientations on a power cage to perform different types of exercises with the same dip bar(s).

19 Claims, 5 Drawing Sheets

(51) Int. Cl.
*A63B 21/068* (2006.01)
*A63B 23/12* (2006.01)

(52) U.S. Cl.
CPC ..... *A63B 21/00069* (2013.01); *A63B 21/068* (2013.01); *A63B 23/1218* (2013.01); *A63B 23/1227* (2013.01); *A63B 2209/00* (2013.01); *A63B 2225/093* (2013.01)

(58) Field of Classification Search
CPC . A63B 21/4007; A63B 21/0616; A63B 21/16; A63B 21/06; A63B 21/00; A63B 2209/00; A63B 2225/093; A47F 5/0823
USPC ..... 482/38
See application file for complete search history.

(56) References Cited

U.S. PATENT DOCUMENTS 4,492,375 A 1/1985 Connelly
4,620,701 A 11/1986 Mojden
5,265,973 A * 11/1993 Badstieber ..... E04G 7/22 403/374.2
5,762,436 A * 6/1998 Mosdal ..... A01B 59/00 403/233
7,036,632 B1 * 5/2006 Price ..... A01M 31/025 182/187
7,066,866 B1 6/2006 Mobley
D587,767 S 3/2009 Hauser et al.
7,871,360 B1 1/2011 Hoole
7,918,770 B1 4/2011 Hoole
9,138,609 B2 9/2015 Placide
9,630,046 B2 * 4/2017 Childs ..... A47F 7/00
10,086,226 B2 * 10/2018 Nelson ..... A63B 21/4035
10,422,473 B2 * 9/2019 Inouye ..... F16M 13/022
2004/0248713 A1 * 12/2004 Campanaro ..... A63B 23/03575 482/123
2006/0278782 A1 * 12/2006 Lockwood ..... A47F 5/0823 248/220.31
2007/0293377 A1 * 12/2007 Webber ..... A63B 21/0615 482/94
2009/0023566 A1 1/2009 Florczak
2014/0080685 A1 * 3/2014 Butler ..... A63B 21/00072 482/102
2016/0346582 A1 * 12/2016 Wilkinson ..... A63B 47/00
2017/0007877 A1 * 1/2017 Leipheimer ..... A63B 21/0783
2017/0202369 A1 * 7/2017 Mercier ..... G01B 21/16
2017/0209735 A1 * 7/2017 McCall, Jr. ..... A63B 21/4029
2017/0246496 A1 * 8/2017 Nelson ..... A63B 21/4035
2018/0117382 A1 * 5/2018 Johanson ..... A63B 21/00047
2018/0142832 A1 * 5/2018 Inouye ..... F16M 13/022
2019/0275363 A1 * 9/2019 Jones ..... A63B 23/03508

OTHER PUBLICATIONS

HulkFit Multi-Function Adjustable Power cage with J-Hooks, Dip Bars and Optional Lat Pull-Down Attachment. Published on Amazon.com https://www.amazon.com/HulkFit-Multi-Function-Adjustable-Attachment-1000-Pound/dp/B07FBDVJN5/ref=sr_1_1?ie=UTF8&qid=1532627888&sr=8-1&keywords=hulkfit.

* cited by examiner

DIP BAR FOR A POWER CAGE

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an exercise dip bar. More particularly, the present dip bar is removably secured to an exercise power cage and provides for a variety of different exercise configurations.

Description of Related Art Including Information Disclosed Under 37 CFR 1.97 and 1.98

One of the more common forms of strength conditioning is with the use equipment that utilizes just the weight of the user. These exercises are typically dips, pull-ups and push-ups. For dips the user grasps two, spaced tubes or bars and pushes down with their arms to elevate their body. For pull-ups the two parallel bars are placed above the body and the user grasps the two bars to lift their body up. When push-ups are being performed, the two bars are placed near or above the ground. The user places their feet on the ground and pushes on the two parallel bars to lift only about half of their body weight. There are other variations depending upon the amount of strength that is required for the exercise and the range of motion. These exercises utilize chest and triceps muscles. To accommodate taller and shorter people the bars are typically placed on power cages that provide a plurality of connection locations to set the height of the bars.

A number of patents and or publications have been made to address these issues. Exemplary examples of patents and or publication that try to address this/these problem(s) are identified and discussed below.

U.S. Pat. No. 4,620,701 issued on Nov. 4, 1986 to Daniel R. Mojden and is titled Adjustable Exercise Apparatus. This patent discloses an adjustable exercise apparatus with a pair of elongated handle members capable of being grasped by an exercising individual. The handles extend, in cantilevered fashion, from a support bar which is disposed substantially horizontally. The horizontal bar is connected to a vertical pillar by a vertical angle adjusting arrangement and the pillar is mounted upon a stationary base. The vertical angle adjusting arrangement permits the horizontal bar and connected handles to be adjusted into any one of a plurality of mutually parallel positions angularly spaced apart from one another in respective vertical planes. This patent only allows the bar(s) to operate on a post frame.

U.S. Pat. No. 7,781,360 issued on Jan. 18, 2011 and U.S. Pat. No. 7,918,770 issued on Apr. 5, 2011, both to Richard J. Hoole are titled Adjustable Weight-Loaded Dip-Chin Machine. These patents disclose an adjustable weight-loaded dip-chin machine. Dip bars and chin bars with means for vertical adjustment are mounted on columns, which in turn are mounted on a base. An arm is pivotally attached to the base, and weights can be added to an arm spindle attached to the arm. A belt is attached to the arm, and weights added to the arm spindle resist upward motion of an exerciser performing dips or chins. Dip bars incorporate a plurality of dip bar legs, each a differing distance from the other dip bar. While these patents use separate bars, the bars only operate and slide on the vertical columns.

U.S. Patent Application Publication 2009/0023566 was published on Jan. 22, 2009 to Phillip Florczak and is titled Exercise System and Related Methods. This publication discloses a system and methods for facilitating exercise. It provides a portable apparatus on which a human can engage in a wide variety of exercises. The system includes an apparatus which, in one embodiment, includes support elements joinable by a stabilizer and supported on bases that form a system base. The attachment for the exercise only operate on the proprietary frame.

What is needed is a dip bar for a power cage. The dip bar in this disclosure provides a solution that operates with a power cage and provides more options for exercise that are not possible with prior art dip bars.

BRIEF SUMMARY OF THE INVENTION

It is an object of the dip bar for a power cage to allow for installation on different sizes of power cage tubes. Cage frames are typically constructed with box tubes that vary in size of 2 inches by 2 inches or 2 inches by 3 inches. These common sizes require some versatility in the mounting to accept the different dimensions of the cage frame. The dip bar being disclosed accommodates both sizes of power cages.

It is an object of the dip bar for a power cage to provide multiple orientations of installation of the dip bar on the frame of a power cage. The dip bar wraps partially around the frame to provide multiple locations to grasp the dip bar and provides different spacing from the power cage uprights or stanchions. The dip bar is secured to the frame to allow the frame and dip bar to be placed in various directions on a power cage.

It is an object of the dip bar for a power cage to securely retain the dip bar onto the power cage. The frame of the dip bar has a rod, post or tube the passes through cage frame to prevent the dip bar from sliding on the power cage. Because the power cage is constructed with multiple holes for locating supports, any of the multiple holes can be used to locate and retain the frame of the dip bar onto the power cage.

It is another object of the dip bar for a power cage to include a safety retainer that prevents undesirable disengagement with the power cage. The safety retainer is a pin with a spring-loaded ball. Once the frame is placed onto the power cage the pin is inserted through holes in the frame, depending upon the tubing of the power cage, to prevent the frame from sliding out of engagement in the power cage. The pin is placed through the frame where the spring-loaded ball extends to retain the pin and the frame on the power cage.

It is another object of the dip bar for a power cage for the dip bar to be positionable at different heights on a power cage to perform different types of exercises. Depending upon the height where the dip bar is located a variety of exercises can be performed. Placing the dip bar high on the power cage allows for pull-ups. Placing the dip bar at a middle height of the power cage allows for dips, and lower locations on the power cage provides of push-ups with varying levels of intensity and inverted push-ups can also be performed by lifting oneself from under the dip bars.

It is still another object of the dip bar for a power cage to allow for several widths of spacing between the dip bars. Because the dip bar wraps around the frame at different distances from the frame the distance between the uprights or stanchions of the power cage allows for different exercises based upon the distance between the dip bar and the shoulder width of the user.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
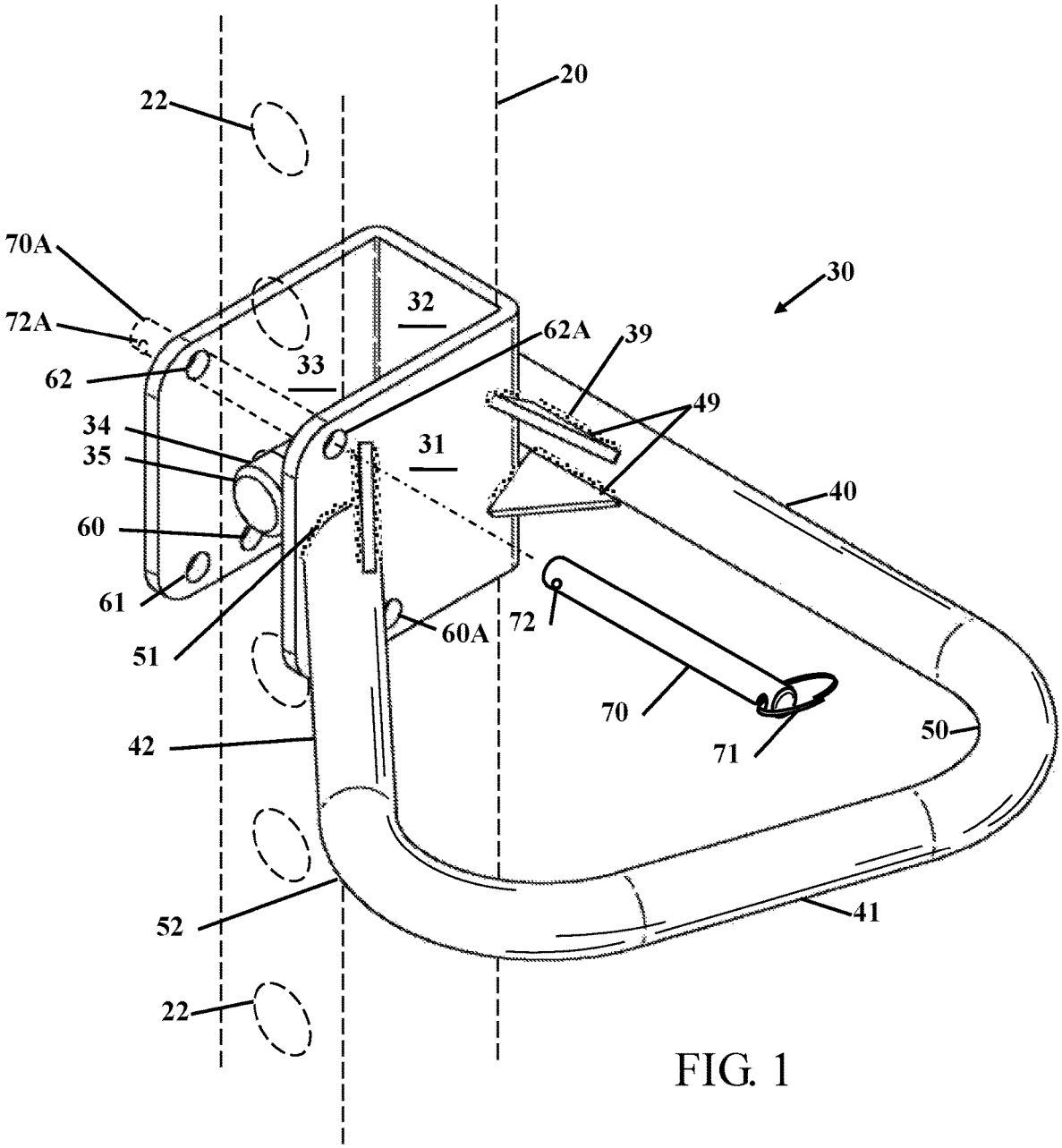
FIG. 1 shows a perspective view of a dip bar for a power cage.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

20 stanchion (2×3)
21 stanchion (2×2)
22 hole
29 ground
30 dip bar
31 near side (frame)
32 back side (frame)
33 far side (frame)
34 post
35 fillet
36 lower position
37 middle position
38 top position
39 weld
40 straight tube
41 return tube
42 angle tube
49 gusset
50 angle bend
51 weld
52 return bend
60 2×2 inside hole 60A 2×2 outside hole
61 2×3 inside hole 61A 2×3 outside hole
62 2×3 outside hole 62A 2×3 inside hole
63 stanchion
70 pin
71 ring
72/72A spring loaded ball
74 outside pin placement
75 inside pin placement
80 difference
81 large
82 small.

FIG. 1 shows a perspective view of a dip bar 30 for a power cage 20. A power cage is typically constructed from 2×2 inch square or 2×3 inch rectangular tubing 20. The vertical uprights or stanchions 20 have a plurality of holes 22 spaced at intervals along the tubing. The uprights or stanchions 20 provide structural support for securing supports for holding weights or, in this application, the holes 22 are for securing the dip bar 30. The dip bar 30 has a post 34 that fits through the holes 22 that pass through the stanchion 20. The end of the post 34 has a chamfer 35 that makes insertion of the post 34 easier to locate and guide into the hole 22. The post 34 in this embodiment, is a solid post, but could be a tube with an open center.

The post 34 is welded or otherwise secured to the back 32 of the frame. The frame has three sides, the back side 32, the inside frame 31 and the far side frame 33. In addition to providing a support for the post 34, the sides 31, 32 and 33 of the frame provide structure to the dip bar 30 that reduces movement and tipping of the dip bar 30. The inside frame 31 and the far side frame 33 have a plurality of holes. The holes allow for the placement of a retaining pin through the frame. The retaining pin is located based upon the visible hole and the size of tubing that is used in the power cage 20.

The retaining pin has a pin 70 with a spring loaded ball 72 on one end and a ring 71 on the second end. The spring-loaded ball 72 is depressed as the pin 70 is passed into a hole, and the spring-loaded ball 72A expands out of the diameter of the pin 70 when the spring-loaded ball 72 is not in a hole. The ring 71 prevents pushing the pin 70 too far through a hole and also allows for connection of a tether to keep the pin 70 with the dip bar 30.

In this example, when the dip bar 30 is used with a 2×3 stanchion 20 the pin 70 is placed into hole 62A and then through hole 62. Alternatively, the pin can be placed through hole 61A (not visible) located under the bent tube and then through hole 61. The selection of the upper or lower holes are selected based upon visibility or user preference. The pin 70 can also be placed through the frame in the opposite direction without a difference in operation or security. When the dip bar 30 is used on a 2×2 stanchion, holes 60 and 60A can be used to secure the dip bar 30 onto a 2×2 power cage stanchion. The holes 60, 60A and 61, 61A and 62, 62A are concentrically aligned and sized to accept the pin 70 there through.

The frame and the joined components are made of metal, and preferably made of steel that has been surface treated, such as painted or powder coated. The frame has a tube welded or otherwise secured to the frame. The tube is welded or otherwise secured to the back 32 of the frame. The straight tube 40 is welded to the flat back surface of the frame. The straight tube 40 then has an angle bend 50 with a return tube 41 and a return bend 52 that terminates at the near side 31 of the frame where the angle tube 42 is welded 51 or otherwise secured. One or a plurality of gussets 49 are welded 39 to the tubes and frame to increase the strength of the dip bar 30.

Figure 2:
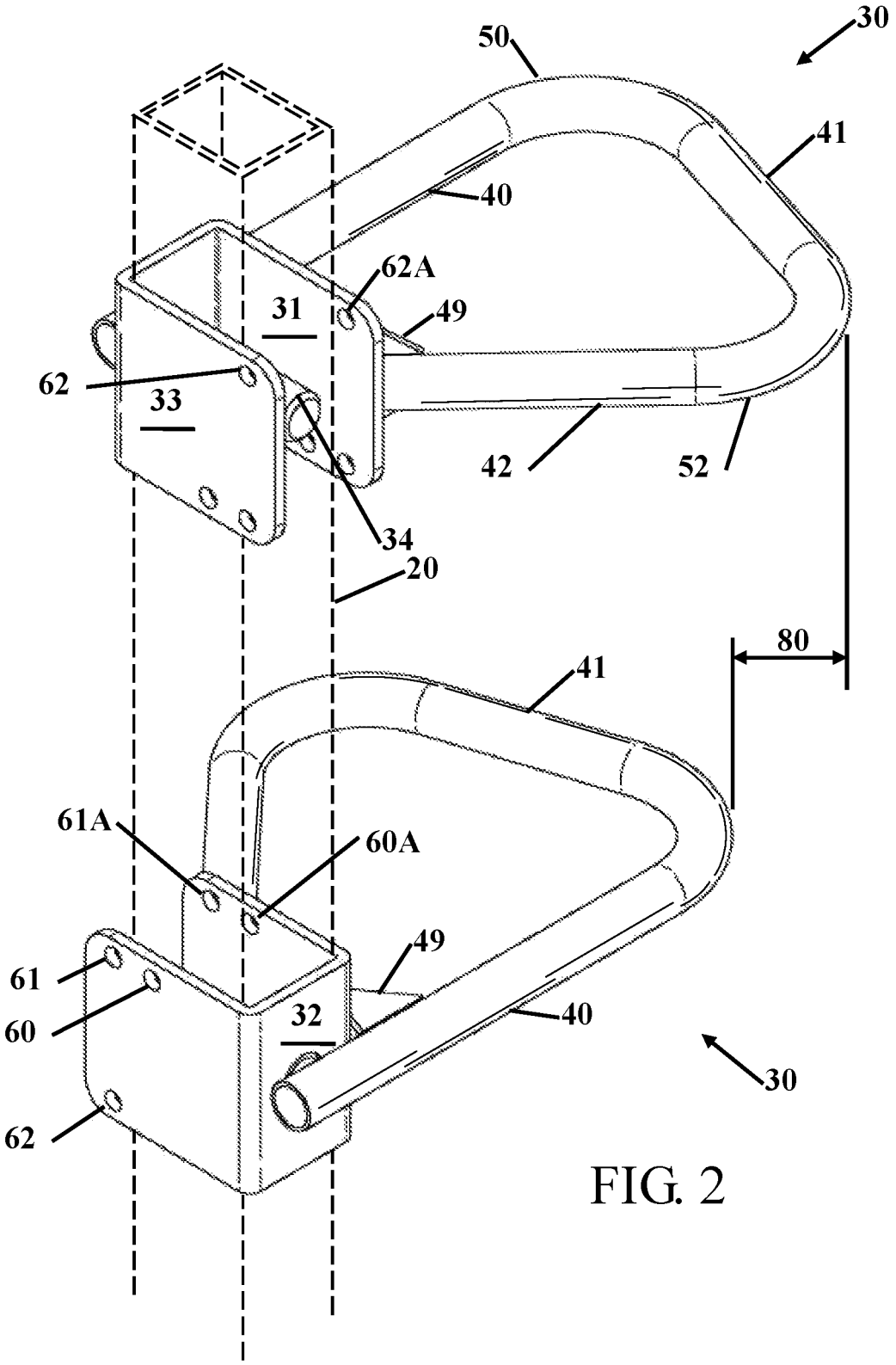
FIG. 2 shows two dip bars and the difference is dimensions based upon placement orientation on the same stanchion.

The different bends of the dip bars 30 allow for different distances based on the placements of the dip bar 30 on a power cage. FIG. 2 shows two dip bars 30 and the difference in dimensions based upon placement orientation on the same stanchion. The dip bars 30 are placed in opposing directions on the same 2×3 stanchion 20. This figure shows the difference 80 in the dimension between the differently or oriented dip bars 30. In this figure, it should also be easily seen that the different gripping locations 40, 41 and 42 allow a user to grasp the dip bar(s) 30 at different angles of hand and wrist pronation and supination.

Figure 3:
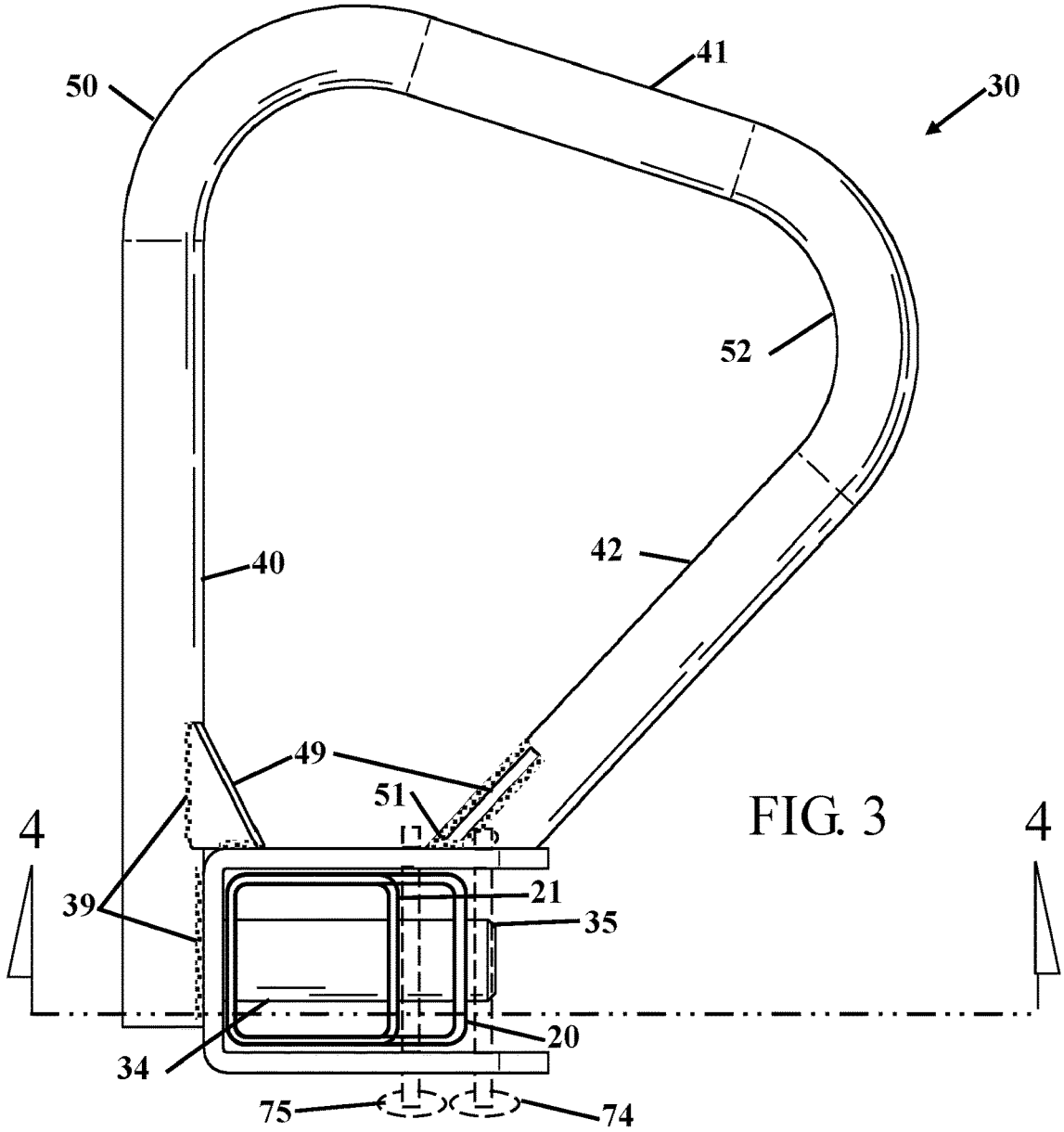
FIG. 3 shows a top view of the dip bar on a power cage stanchion.
Figure 4:
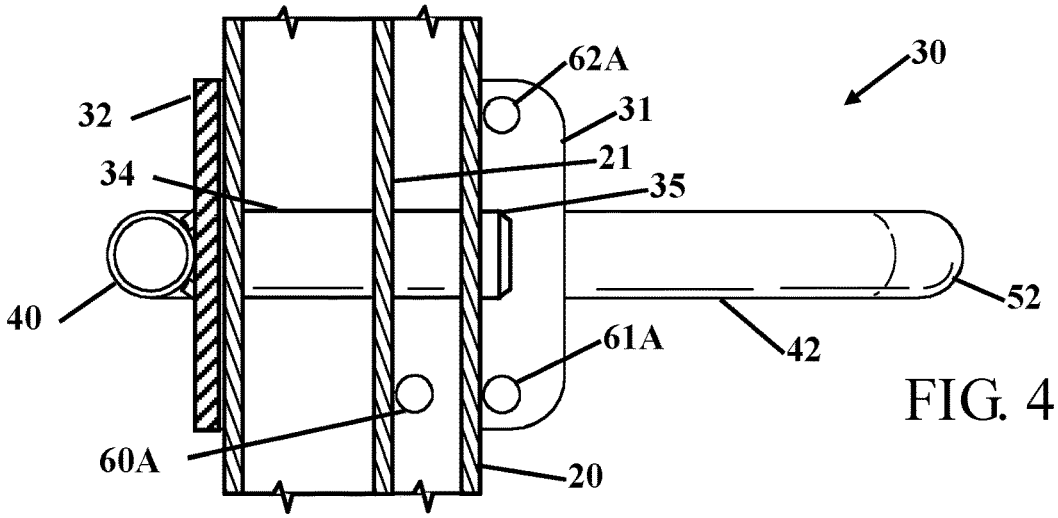
FIG. 4 shows a side sectional view cut from section 4-4 in FIG. 3.

FIG. 3 shows a top view of the dip bar on a power cage stanchion 20 and FIG. 4 shows a side sectional view cut from section 4-4 in FIG. 3. This figure shows the frame with a 2×2 stanchion 21 and a 2×3 stanchion 20. In the case of the 2×2 stanchion 21, the location of the pin 75 passing through hole 60A is secured to the stanchion 21. In the case of the 2×3 stanchion 20, the location of the pin 74 can pass through holes 61A or 62A. In the cross-section of FIG. 4, the post 34 is shown passing through the two holes of the stanchion 20 or 21.

Figure 5:
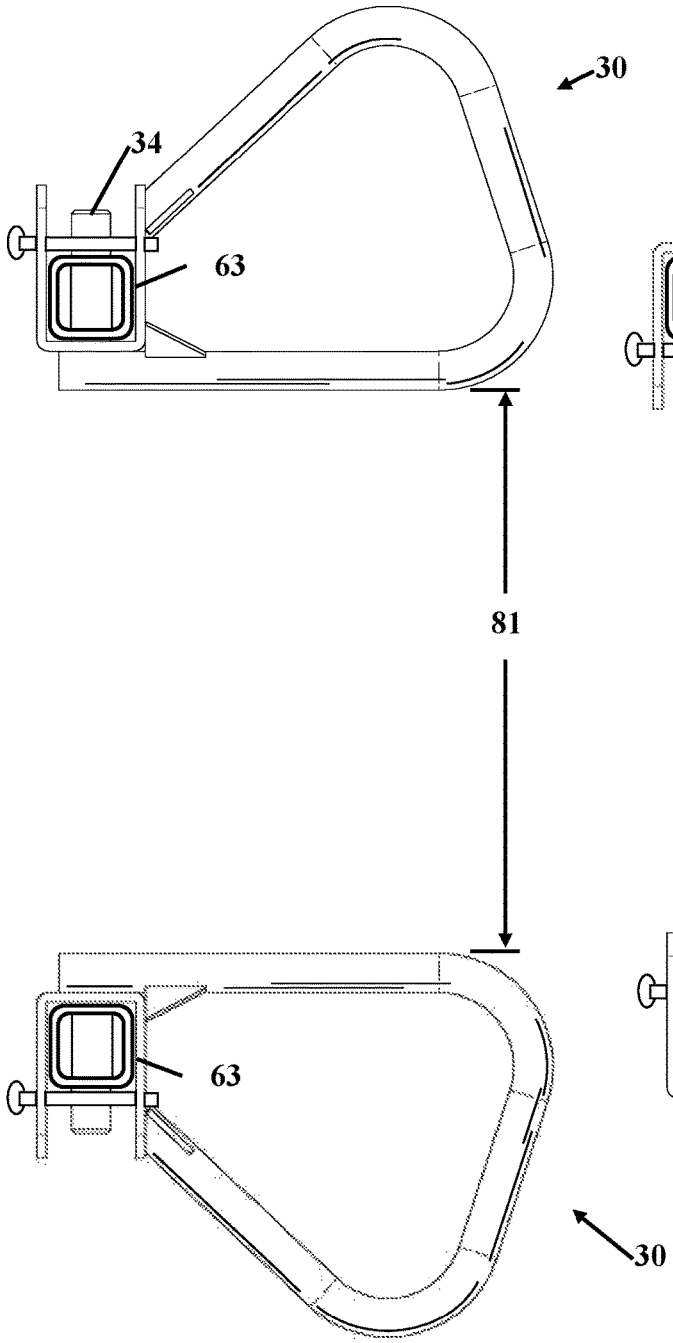
FIG. 5 shows the dip bars placed to larger inside size.
Figure 6:
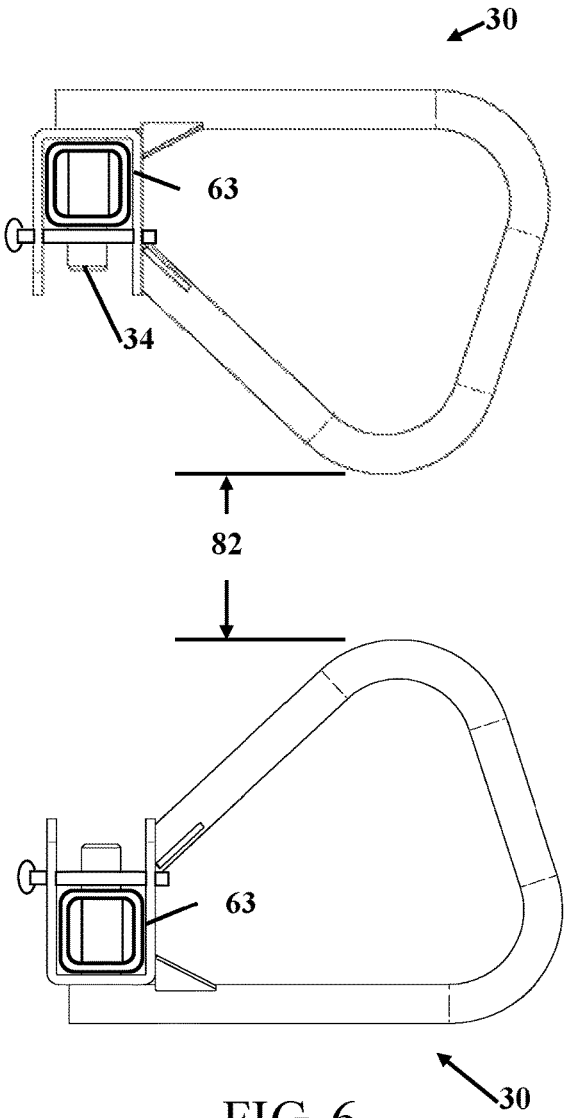
FIG. 6 shows the dip bars placed to a smaller inside size.

FIG. 5 shows the dip bars placed to larger inside size and FIG. 6 shows the dip bars placed to a smaller inside size. The 2×2 stanchions 63 with the same spacing between the stanchions 63. Because of the compound bends of the dip bars 30 spacing, 81 vs 82 the same dip bars 30 can be used to provide a variety of exercises using different muscle groups.

Figure 7:
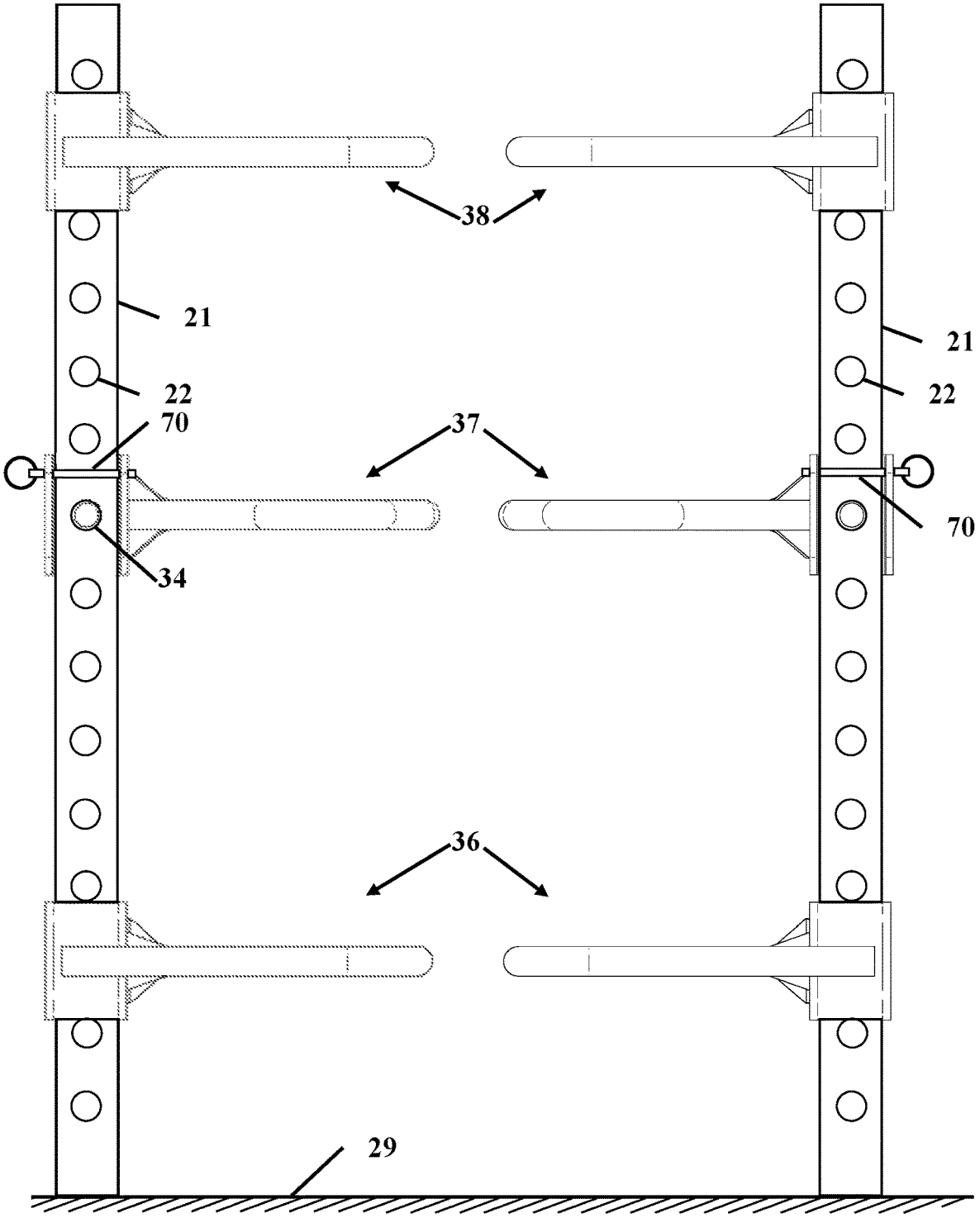
FIG. 7 shows dip bars placed at different heights on stanchions of a power cage.

FIG. 7 shows dip bars placed at different heights on stanchions of a power cage. The lower positon 36 of the dip bars 30 from the ground 29 can be used for push-ups. Depending upon how close the dip bars 30 are placed to the ground 29 the amount of upper body effort and the muscle groups that are used can be adjusted. In the middle positon 37, the user can perform dips, or the user can hang under the dip bars 30 to perform reverse push-ups. When the dip bars 30 are placed in the top or upper location 38 the user can perform pull-ups. While the dip bars 30 are shown at different heights and locations on the stanchions 20, the dip bars 30 can be located at any hole 22 position.

In summary, each dip bar 30 has essentially three grasp positions, and on a 2×2 stanchion each dip bar 30 can be placed in two essential orientations on each stanchion. Placing the dip bar 30 on the narrow or wide side of the cage provides additional grip distances. This combination provides 12 different grasp and spacing for a user. On a 2×3 stanchion each dip bar 30 can be placed in two orientations. This gives 6 different grasps and spacing for a user. The grips can be angled to the user body or parallel to the user body.

Thus, specific embodiments of a dip bar for a power cage have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A dip bar for a power cage comprising:

a frame having a back side connected on one side to a near side and on an opposing side to a far side, thereby creating an open three-sided frame;

said back side having a fixed post that extends perpendicular thereon into said open three-sided frame;

said near side and said far side having at least two holes that extends concentrically through;

a retainer pin;

said at least two holes sized to accept said retainer pin, and a single tube that extends outside and away from said open three-sided frame, said single tube further has at least two angle bend sections, with at least one straight tube of said single tube that is joined along said back side, and a return tube of said single tube that extends back to said open three-sided frame and joins to said near side at an angle that is relative to said near side.

2. The dip bar for a power cage according to claim 1, wherein said open three-sided frame is sized to accept a 2-inch by 2-inch stanchion wherein said fixed post is configured to pass into said stanchion from an open front side and said retainer pin is configured to pass outside of said stanchion to retain said open three-sided frame on said stanchion.

3. The dip bar for a power cage according to claim 1, wherein said open three-sided frame is sized to accept a 2-inch by 3-inch stanchion wherein said fixed post is configured to pass into said stanchion from an open front side and said retainer pin is configured to pass outside of said stanchion to retain said open three-sided frame on said stanchion.

4. The dip bar for a power cage according to claim 1, wherein said open three-sided frame is sized to accept a 2-inch by 2-inch stanchion and a 2-inch by 3-inch stanchion wherein said fixed post is configured to pass into said stanchion from an open front side and said retainer pin is configured to pass outside of said stanchion to retain said open three-sided frame on said stanchion.

5. The dip bar for a power cage according to claim 4, further includes at least two additional holes wherein said at least two holes retains said frame on said 2-inch by 2-inch stanchion and said at least two additional holes retains said frame on said 2-inch by 3-inch stanchion.

6. The dip bar for a power cage according to claim 1, wherein said fixed post is sized to fit a hole in a stanchion.

7. The dip bar for a power cage according to claim 1, wherein said fixed post is a tube or a rod.

8. The dip bar for a power cage according to claim 1, wherein a free end of said fixed post is chamfered or rounded.

9. The dip bar for a power cage according to claim 1, wherein at least one of said at least one straight tube of said single tube is parallel to said back side.

10. The dip bar for a power cage according to claim 1, further includes at least two gussets that connects said tube to said frame.

11. The dip bar for a power cage according to claim 1, wherein said dip bar is fabricated from metal.

12. The dip bar for a power cage according to claim 1, further includes a second dip bar.

13. The dip bar for a power cage according to claim 12, wherein said two dip bars are configured for mounting on a power cage.

14. The dip bar for a power cage according to claim 13, wherein said two dip bars are configurable to provide at least two different rotational orientation between said two dip bars when placed on a power cage.

15. The dip bar for a power cage according to claim 1, wherein said retainer pin further includes a spring-loaded ball that retains said retainer pin in said at least two holes of said frame.

16. The dip bar for a power cage according to claim 1, wherein said retainer pin further includes a ring that passes through said retainer pin to retain said retainer pin with said dip bar.

17. The dip bar for a power cage according to claim 1, further includes a stanchion and said frame is removable from said stanchion through an open front side of said open three-sided frame.

18. The dip bar for a power cage according to claim 1, wherein said fixed post extents into said open three-sided frame from under said straight tube.

19. The dip bar for a power cage according to claim 1, wherein said fixed post prevents said frame from sliding on a stanchion.

* * * * *